US010722895B2

(12) United States Patent
McCloskey et al.

(10) Patent No.: US 10,722,895 B2
(45) Date of Patent: Jul. 28, 2020

(54) CONE CRUSHER

(71) Applicant: McCloskey International Limited, Keen (CA)

(72) Inventors: James Paschal McCloskey, Keen (CA); Andrzej Krol, Keen (CA); Dennis Duellman, Keen (CA)

(73) Assignee: McCloskey International Limited, Keen (CA)

( * ) Notice: Subject to any disclaimer, the term of this patent is extended or adjusted under 35 U.S.C. 154(b) by 235 days.

(21) Appl. No.: 15/953,698

(22) Filed: Apr. 16, 2018

(65) Prior Publication Data

US 2018/0297032 A1 Oct. 18, 2018

Related U.S. Application Data

(60) Provisional application No. 62/486,127, filed on Apr. 17, 2017.

(51) Int. Cl.
*B02C 2/04* (2006.01)

(52) U.S. Cl.
CPC ..... *B02C 2/04* (2013.01)

(58) Field of Classification Search
CPC ..... B02C 2/04
See application file for complete search history.

(56) References Cited

U.S. PATENT DOCUMENTS 1,553,202 A * 9/1925 Symons ..... B02C 2/045 241/215
2,190,036 A * 2/1940 Morch ..... B02C 2/06 241/156
2,594,080 A * 4/1952 Shafter ..... B02C 2/005 241/299
2,813,685 A * 11/1957 Macleod ..... B02C 2/005 241/299
2,989,253 A * 6/1961 Macleod ..... B02C 2/005 241/294
3,038,670 A * 6/1962 Becker ..... B02C 2/045 241/30
3,565,353 A * 2/1971 Howard ..... B02C 2/005 241/207
3,604,640 A 9/1971 Webster
3,966,130 A 6/1976 Doty
(Continued)

FOREIGN PATENT DOCUMENTS

EP 2532431 12/2012
GB 139216 A * 4/1921 ..... B02C 2/06

*Primary Examiner* — Faye Francis
(74) *Attorney, Agent, or Firm* — Schwabe, Williamson & Wyatt, P.C.

(57) ABSTRACT

The present disclosure provides a generally cylindrical bowl support for a cone crusher which includes a plurality of evenly, circumferentially spaced ears around the periphery of the support. The ears are designed to have clamping cylinders mounted thereto to provide protection from tramp iron and the like passing through the cone crusher. A plurality of thickened ribs are defined in the support, at least some of the thickened ribs extending downwardly from the ears to form abutting polygon configurations to spread and absorb forces from a crushing operation. Other ones of the ribs define at least one circumferentially-extending, continuous ring forming portions of the polygons.

8 Claims, 6 Drawing Sheets

(56) References Cited

U.S. PATENT DOCUMENTS

| | | | | |
|---|---|---|---|---|
| 5,769,340 | A * | 6/1998 | Jean | B02C 2/045 241/207 |
| 6,299,083 | B1 * | 10/2001 | Polinski | B02C 2/06 241/207 |
| 9,205,427 | B2 * | 12/2015 | Lindberg | B02C 2/02 |
| D781,938 | S * | 3/2017 | Svedensten | D15/123 |
| 2010/0270409 | A1 * | 10/2010 | Eriksson | B02C 2/005 241/207 |
| 2014/0284410 | A1 * | 9/2014 | Lindberg | B02C 2/02 241/207 |
| 2015/0360228 | A1 | 12/2015 | McCloskey et al. | |

* cited by examiner

CONE CRUSHER

The present application claims priority to U.S. Provisional Application No. 62/486,127, which was filed on Apr. 17, 2017, and titled "HONEYCOMB CONE CRUSHER," and which is hereby incorporated by reference herein.

TECHNICAL FIELD

Embodiments herein relate to the field of cone crushers, and more specifically to relatively lightweight but strong cone crusher frames.

BACKGROUND

Rock crushers reduce the size of rocks in order to provide material for road beds, concrete, building foundations and the like. By definition, rock crushers need to be heavy duty to avoid breakage and bending during the crushing process. Rock crushers may be categorized as cone crushers, jaw crushers, and impact crusher, but this disclosure will focus on cone crushers. Cone crushers break up rocks and other hard material by squeezing or compressing product between convex and concave-shaped surfaces covered by hardened wear surfaces. Cone crushers are normally used as the second or third stage crusher, with a reduction ratio of from about 6 to 8 to 1.

Once such cone crusher is described in U.S. patent application Ser. No. 14/717,651, filed on May 20, 2015, which is incorporated herein by reference. This application describes a cone crusher that is conventional in much of its construction. It includes a conically-shaped head, which is part of an upper rock crusher assembly. The conical head both gyrates or oscillates and rotates relative to a stationary bowl that includes a hardened bowl liner. The spacing between the bowl liner and the cone at any given point opens and closes as the cone oscillates relative to and inside the bowl. Rocks are deposited in the spacing and the rocks slide down between these surfaces as the space opens, and the rocks are crushed as the space closes.

This crushing process develops tremendous pressures and tensions in the stationary frame surrounding the bowl line. To withstand these forces, the frame, sometimes called the base frame, other times called the bowl support, must be extremely heavy duty. This requires a substantial amount of steel, which is typically cast at great expense. It also is very heavy, creating transport difficulties, particularly if the cone crusher is part of a mobile crushing plant.

In attempts to reduce the amount of steel used in cone crusher frames, circumferential bands of steel are sometimes used in place of the entire frame being a thick wall of steel. While the use of circumferential bands may tend to reduce the required amount of steel in the rest of the frame, the bands are not as effective as they might be in spreading the crushing forces.

BRIEF DESCRIPTION OF THE DRAWINGS

Embodiments will be readily understood by the following detailed description in conjunction with the accompanying drawings and the appended claims. Embodiments are illustrated by way of example and not by way of limitation in the figures of the accompanying drawings.

DETAILED DESCRIPTION OF DISCLOSED EMBODIMENTS

Figure 1:
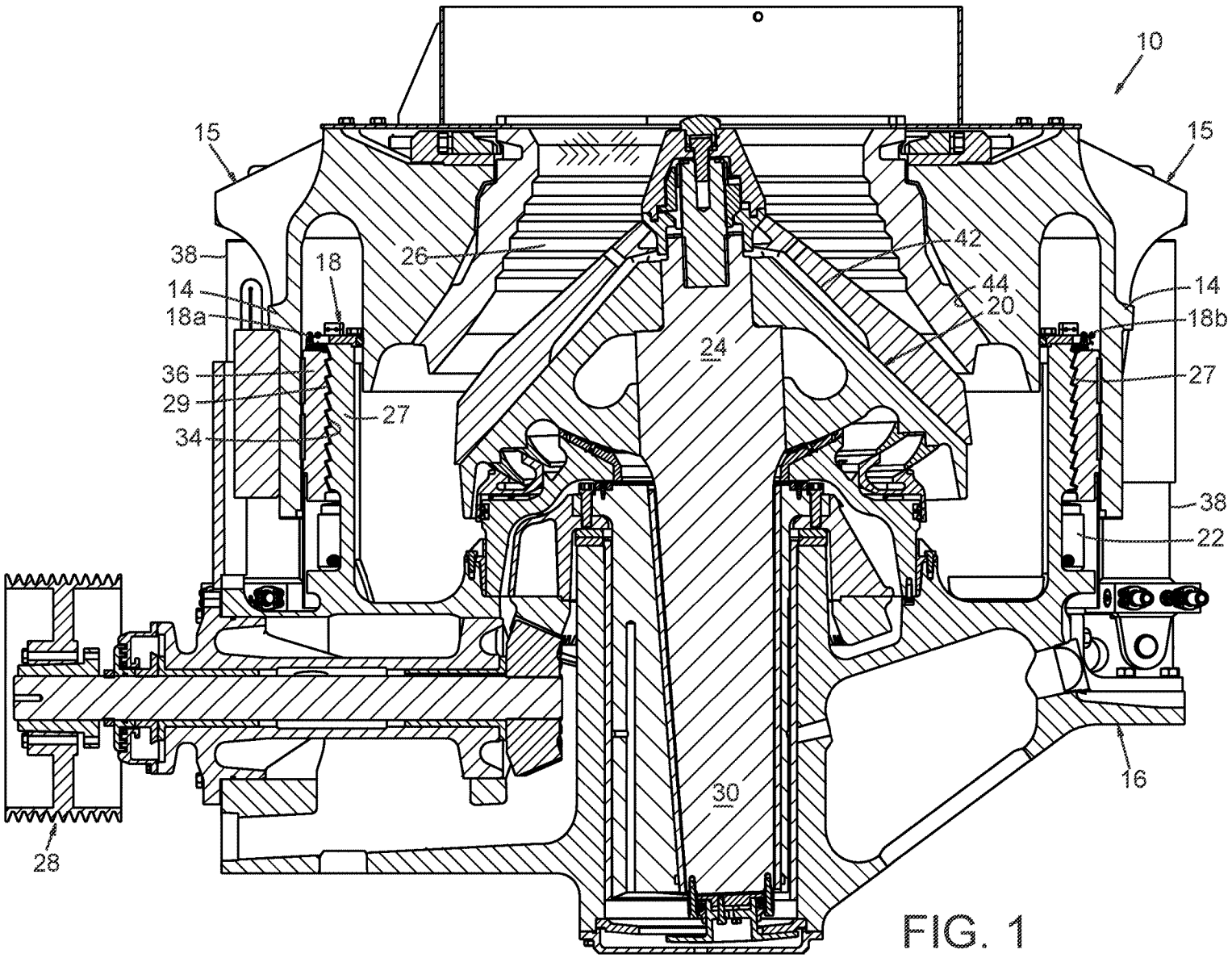
FIG. 1 is a side elevation sectional view of a cone crusher into which any of the embodiments of the upper bowl support disclosed herein may be incorporated.

In the following detailed description, reference is made to the accompanying drawings which form a part hereof, and in which are shown by way of illustration embodiments that may be practiced. It is to be understood that other embodiments may be utilized and structural or logical changes may be made without departing from the scope. Therefore, the following detailed description is not to be taken in a limiting sense.

Various operations may be described as multiple discrete operations in turn, in a manner that may be helpful in understanding embodiments; however, the order of description should not be construed to imply that these operations are order-dependent.

The description may use perspective-based descriptions such as up/down, back/front, and top/bottom. Such descriptions are merely used to facilitate the discussion and are not intended to restrict the application of disclosed embodiments.

The terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

For the purposes of the description, a phrase in the form "A/B" or in the form "A and/or B" means (A), (B), or (A and B). For the purposes of the description, a phrase in the form "at least one of A, B, and C" means (A), (B), (C), (A and B), (A and C), (B and C), or (A, B and C). For the purposes of the description, a phrase in the form "(A)B" means (B) or (AB) that is, A is an optional element.

The description may use the terms "embodiment" or "embodiments," which may each refer to one or more of the same or different embodiments. Furthermore, the terms "comprising," "including," "having," and the like, as used with respect to embodiments, are synonymous, and are generally intended as "open" terms (e.g., the term "including" should be interpreted as "including but not limited to,"

the term "having" should be interpreted as "having at least," the term "includes" should be interpreted as "includes but is not limited to," etc.).

With respect to the use of any plural and/or singular terms herein, those having skill in the art can translate from the plural to the singular and/or from the singular to the plural as is appropriate to the context and/or application. The various singular/plural permutations may be expressly set forth herein for sake of clarity.

One aspect of the present disclosure provides a generally cylindrical bowl support for a cone crusher which includes a plurality of evenly, circumferentially spaced ears around the periphery of the support. The ears are designed to have clamping cylinders mounted thereto to provide protection from tramp iron and the like passing through the cone crusher. A plurality of thickened ribs are defined in the support, at least some of the thickened ribs extending downwardly from the ears to form abutting polygon configurations to spread and absorb forces from a crushing operation. Other ones of the ribs define at least one circumferentially-extending, continuous ring forming portions of the polygons. At least some of the polygons may be regular hexagon configurations, and some of them may be rectangular configurations. Some of the polygons may alternatively be irregular hexagon configurations. Some of those irregular hexagon configurations may be of the same configuration as other irregular hexagon configurations but are inverted.

Another aspect of the disclosure is a cone crusher having a crusher bowl and a generally cylindrical bowl support. The bowl support may include a plurality of raised ribs that form a plurality of abutting polygons defining substantially the entire outer surface of the bowl support. At least some of those polygons may form a honeycomb-like configuration. The bowl support may be defined by a wall of a given thickness, and the ribs having a thickness that is greater than that of the wall thickness This embodiment may include circumferentially-spaced ears formed at an upper portion of the bowl support, and ear ribs for supporting the ears, wherein the ear ribs interconnect with other ribs to distribute forces throughout the bowl support.

This discussion of the preferred embodiments will begin with what is conventional. FIG. 1 is a side elevation sectional view of any one of the preferred embodiments of a cone crusher. This cone crusher, identified generally at 10, typically includes an upper bowl support 14 and a base frame 16. Upper bowl support 14 also may include a plurality of evenly spaced ears, shown generally at 15. An adjustment gear assembly 18, a locking ring 36 and a crusher bowl 27 may also be provided. A crusher cone 20 is covered by a mantle 42. Adjustment gear assembly 18 typically includes a large adjustment gear 18*a*, a pinion or small adjustment gear 18*b*, and an adjustment gear motor 22.

Crusher bowl 27 may include crusher bowl threads 29 on an outer side and a bowl liner 44 on an inner side, facing mantle 42. Upper bowl support threads 34 are mounted to the inner side of upper bowl support 14, threadably mounted to and complementing crusher bowl threads 29. Crusher bowl threads 29 and upper bowl support threads 34 cooperate as crusher bowl 27 is rotatably adjusted by adjustment gear motor 22 and small adjustment gear 18*a* so the complementing crusher bowl threads 29 and upper bowl support threads 34 adjust crusher bowl 27 upwardly or downwardly with respect to crusher cone 20. This causes the gap between bowl liner 44 and mantle 42, commonly called a crusher cavity 26, to be reduced or increased in size as is desirable for handling different sizes of rocks. The dimension of crusher cavity 26 is commonly called the closed size setting gap, and can be precisely set through the arrangement described above.

A crusher head 24 covered by mantle 42 form crusher cone 20, which during crushing operations is designed to rotate and gyrate to crush rocks as rocks enter crusher cavity 26 and are forced against each other and between mantle 42 and bowl liner 44. A drive assembly 28 provides power to rotate and gyrate crusher head 24 for the crushing operation. Specifically, drive assembly 28 drives a shaft assembly 30 which, in an offset relationship, drives crusher head 24.

Figure 5:
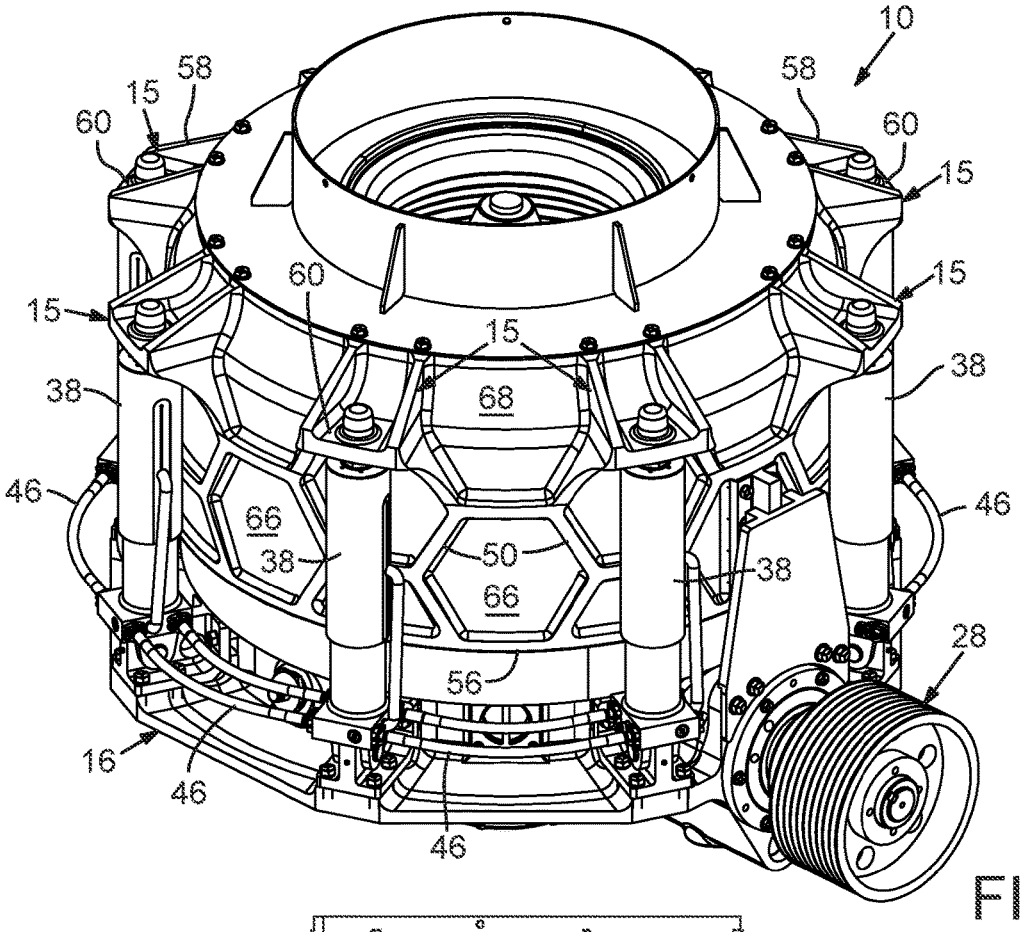
FIG. 5 is a perspective view of the first embodiment of an upper bowl support incorporated into a cone crusher.
Figure 5A:
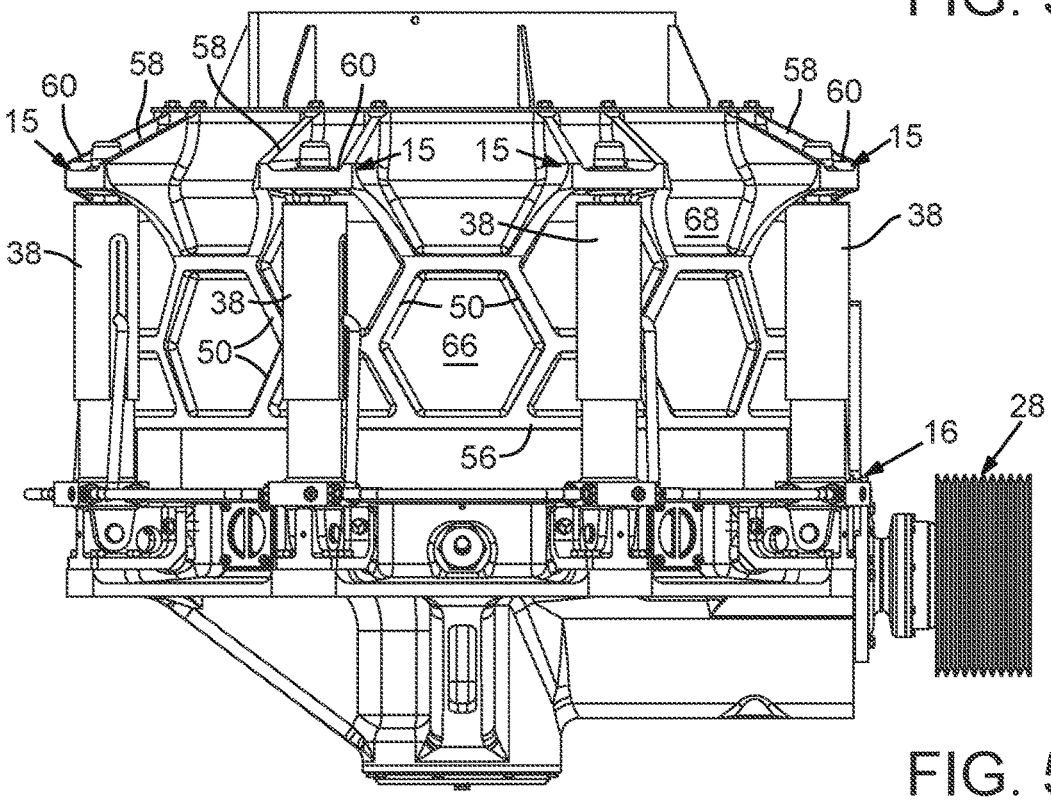
FIG. 5A is a side elevation view of the first embodiment of an upper bowl support incorporated into a cone crusher.

Turning to FIGS. 5 and 5A, a plurality of evenly-spaced, peripherally-positioned clamping cylinders 38 extend between ears 15 of upper bowl support 14 and base frame 16 to provide relief capability to the crusher. This adapts the crusher to handle a large variety of sizes and hardness of materials, and protects the crusher when steel pieces or other uncrushables, commonly called tramp iron, enter crusher cavity 26.

Clamping cylinders 38 include hydraulic systems with hydraulic pressure lines 46 extending therebetween that provide shock absorbing capability to the system, and respond to spikes in hydraulic pressure that might otherwise damage the crusher. Nine clamping cylinders are depicted, but any number of such cylinders may be included, depending upon the desires of the user and the capabilities of the crusher. The number of clamping cylinders corresponds with the number of hydraulic lock cylinders (not shown), also positioned around the periphery of the crusher to lock the bowl in position once it has been adjusted to the size of rocks to be crushed.

The preferred embodiments are designed such that the system reacts to pressure spikes in the clamping cylinders. Specifically, in the event of a large uncrushable entering the crusher, hydraulic pressure will spike in more than one of the clamping cylinders and the pressure would exceed the pre-set relief pressure so that relief valves in more than one of the (normally adjacent) clamping cylinders would pop open, allowing upper bowl support 14 to lift away from base frame 16 to permit the larger uncrushable to pass. Once the increased pressure is reduced, such as after the uncrushable passes through the crusher, this decrease in pressure will be immediately transmitted through the system, permitting the relief valve to return to its original position.

Despite the presence of this relief capability, there still are tremendous forces generated during the crushing process. These forces, generated in crusher cavity 26 as crusher cone 20 is rotated and rocks pass through, cause inward forces on bowl liner 44 but the principal concern is the absorption of the forces radiating outwardly against mantel 42. These forces are conveyed from mantel 42 through crusher bowl 27 to upper bowl support 14. The forces need to be spread over as much of the upper bowl support as possible so that forces are not concentrated in one spot or region.

As mentioned above, conventional upper bowl supports often attempted to spread these forces around the upper bowl support through the use of one or more circumferential rings. The rings are typically formed of heavily fortified steel, serving to absorb and spread forces throughout the upper bowl support. Other portions of the upper bowl support may be thinner in order to reduce the amount of steel used and the weight of the upper bowl support. However, circumferential rings do not distribute the forces in an even manner so stress points appear throughout the upper bowl support, requiring that these other portions of the upper bowl support be engineered with heavier reinforcing steel.

The depicted embodiments include unique methods of distributing the forces generated during crushing operations that include shaped, intersecting, reinforcing ribs formed in the wall of upper bowl support 14. These ribs spread forces throughout upper bowl support 14 in such a manner that the remaining portions of the upper bowl support can be formed of thinner steel. This means that the upper bowl support 14 can be lighter weight and therefore potentially less expensive. As noted earlier, this in turn means that the entire crusher 10 can be lighter in weight, which is a meaningful advantage because crushers often need to be transported between crushing sites. This is particularly advantageous for lighter weight, mobile crushers that are mounted to vehicles.

In a first embodiment of crusher 10 depicted in FIGS. 1-5 and 5A, upper bowl support 14 has a honeycomb-like structure with hexagon-shaped configurations 66, here regular hexagons, being formed in the wall of an upper bowl support. The hexagons are defined between angularly and downwardly-extending ribs 50 and circumferentially-extending ribs 56.

The upper portion of upper bowl support 14 may include somewhat less-regular hexagons 68 defined between ear ribs 58. Ear ribs 58 support ears 15 and ear platforms 60, to which the upper terminus of each of clamping cylinders 38 is mounted.

The upper bowl support 14 may include polygon-shaped configurations. In the figures, the polygon-shaped configurations form parallelograms 52 (see FIG. 2) between angularly and downwardly-extending ribs 50 and circumferentially-extending ribs 56. In the depicted embodiment 10, the parallelogram-shaped configurations are regular or isosceles parallelograms.

Figure 2:
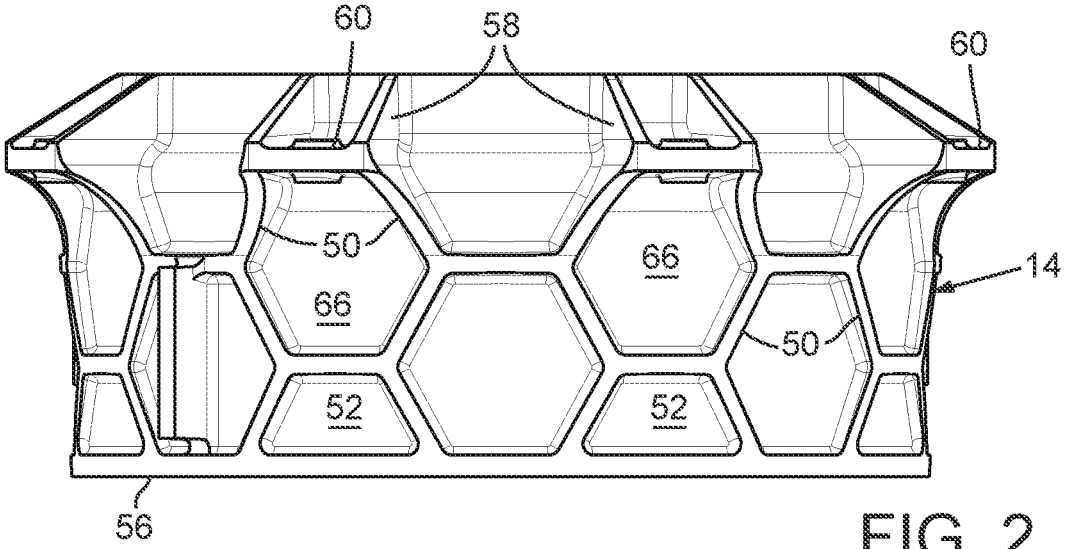
FIG. 2 is a side elevation view of a first embodiment of an upper bowl support.
Figure 3:
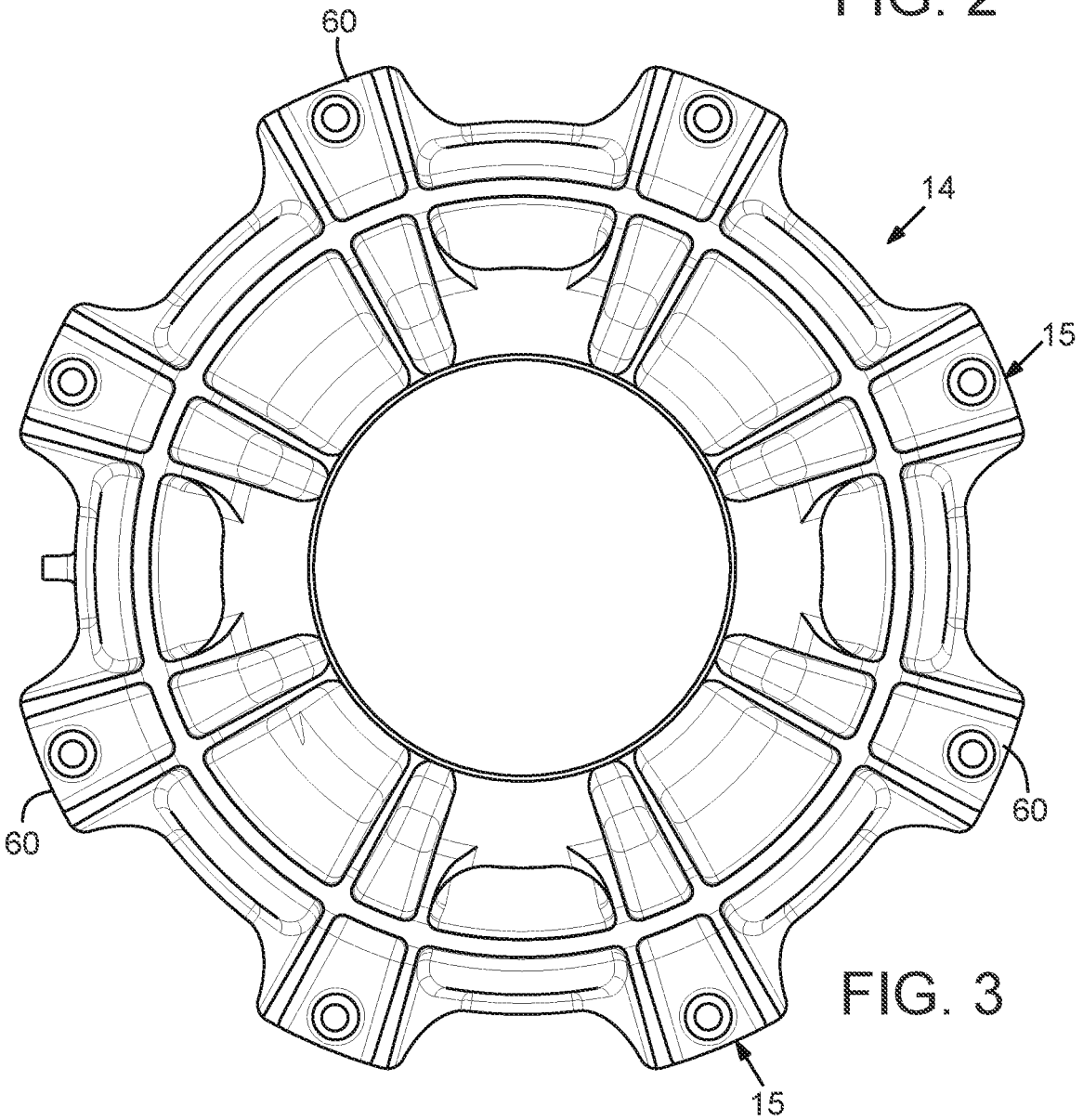
FIG. 3 is a top plan view of any of the three embodiments of an upper bowl support disclosed herein.

Top plan view FIG. 2 and side elevation sectional view FIG. 3 show additional structural aspects of upper bowl support 14, ears 15, ear ribs 58 and ear platforms 60.

The configuration of the ribs in cone crusher 10 not only provide structural integrity to the walls of upper bowl support 14 against the forces created during crushing operations but they also provide an extremely durable mounting for clamping cylinders 38. As noted earlier, these clamping cylinders come into play when extreme forces are created by tramp iron entering crusher cavity 26. For this reason, a secure mounting for clamping cylinders 38 may be important as these forces need to be absorbed by upper bowl support 14 until the relief valve releases the pressure in the clamping cylinders. This is one reason why the clamping cylinders are conventionally mounted to an upper, heavy circumferential ring extending around the upper bowl support. By providing ears 15 instead of this heavy upper circumferential ring, which simultaneously provide structural support for upper bowl support 14, provides a a relatively lightweight structure with great structural integrity.

Figure 4:
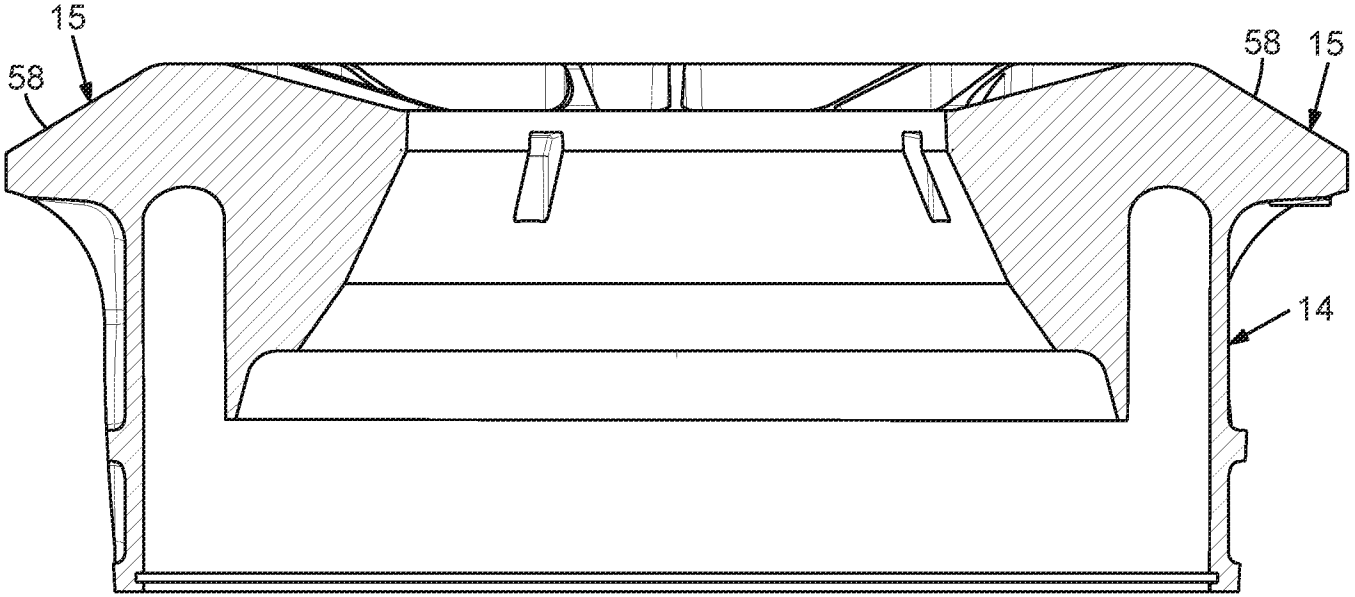
FIG. 4 is a side elevation sectional view of any of the embodiments of an upper bowl support disclosed herein.
Figure 6:
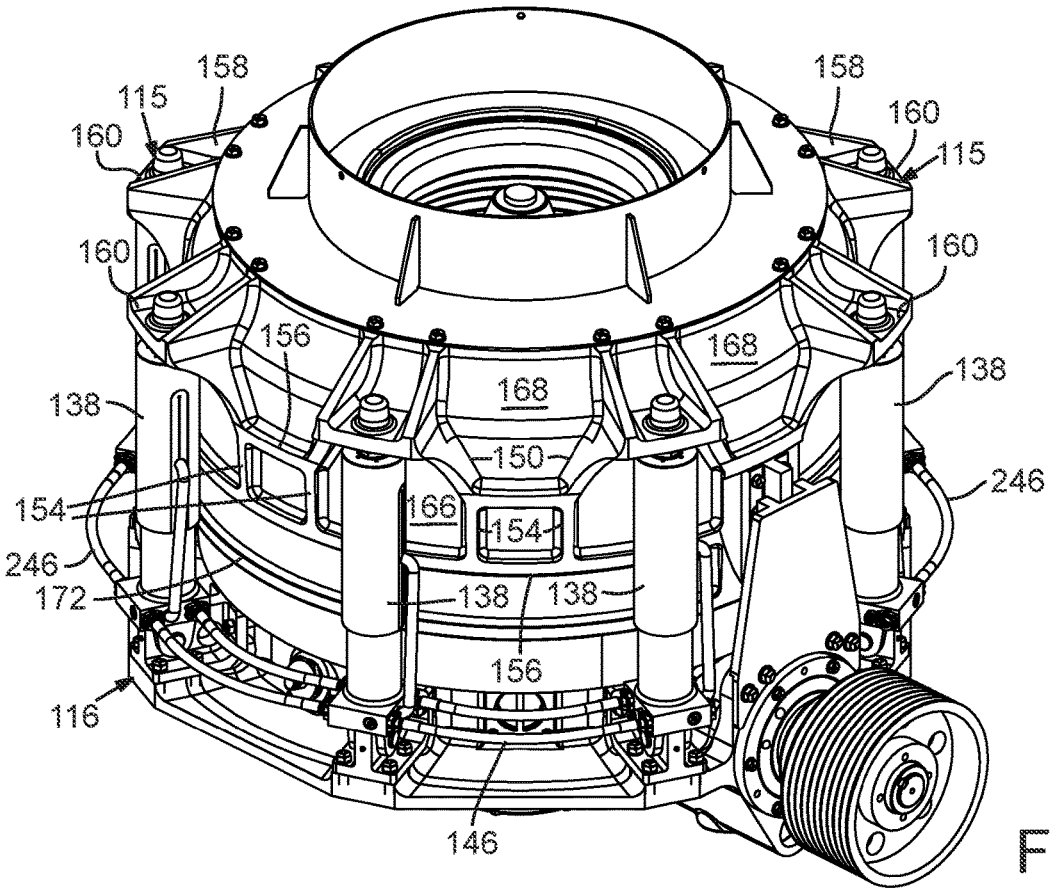
FIG. 6 is a perspective view of a second embodiment of an upper bowl support incorporated into a cone crusher.
Figure 6A:
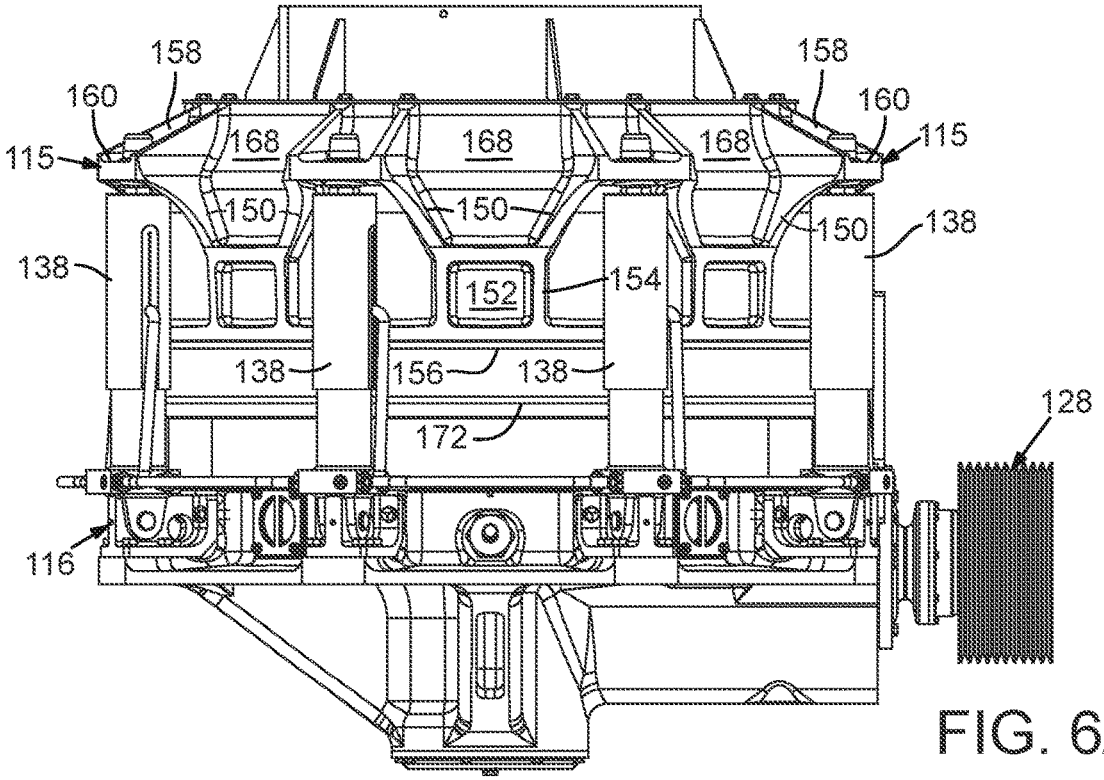
FIG. 6A is a side elevation view of the second embodiment of the upper bowl support incorporated into a cone crusher.

A second embodiment is depicted in FIGS. 6 and 6A, although FIGS. 1, 3 and 4 also depict the construction of this embodiment. This second embodiment has been generally indicated at 110, and because much of the construction of this embodiment is similar to that of the first embodiment 10, corresponding numbers have been used in the 100 series. For simplicity, the components are not renumbered in FIGS. 1, 2 and 3. Because, other than the upper bowl support, the first and second embodiments may be essentially the same, only the upper bowl support 114 of this second embodiment is depicted and will be described.

FIGS. 6 and 6A show angularly and downwardly-extending ribs 150 which extend from ear ribs 158. As in the first embodiment, each of the ears 115 is defined and supported by ear ribs 158 and an interconnecting ear platform 160. Ear platforms 160 combine with angularly and downwardly-extending ribs 150 and downwardly-extending ribs 154 to form a polygon 166, with a complementing, inverted polygon 168 being formed in adjacent structure between ear ribs 158, angularly and downwardly-extending ribs 150 and circumferentially-extending ribs 156. In the embodiment depicted in FIGS. 6 and 6A, polygons 166 and 168 are irregular hexagons.

The angularly and downwardly-extending ribs may interconnect with circumferentially-extending ribs 156 and downwardly-extending ribs 154 to form another polygon, here a rectangular configuration 152. Rectangular configuration 152 may actually be square but this depends on the particular application. As depicted, some of the circumferential ribs 156 may extend around the entire upper bowl support 114. Circumferential ribs 156 can typically be lighter in weight than in conventional designs since the other ribs do such a good job of evenly distributing forces generated during crushing operations. In fact, it may be possible to dispense with the continuous circumferential rib in certain applications.

As depicted, a second circumferential rib 172 may also be provided. As with circumferential rib 156, circumferential rib 172 may also be lighter in weight than circumferential ribs in conventional construction.

A third embodiment is depicted in FIGS. 7 and 7A, although, again, FIGS. 1, 3 and 4 also depict the construction of this embodiment. This third embodiment has been generally indicated at 210, again, because much of the construction of this embodiment is similar to that of the first two embodiments 10 and 110, corresponding numbers have been used in the 200 series. It can be seen, however, that the components are not renumbered in FIGS. 1, 2 and 3. Because, other than the upper bowl support, the third embodiment may be essentially the same as the first embodiment, only the upper bowl support 214 of this third embodiment is depicted and will be described.

Figure 7:
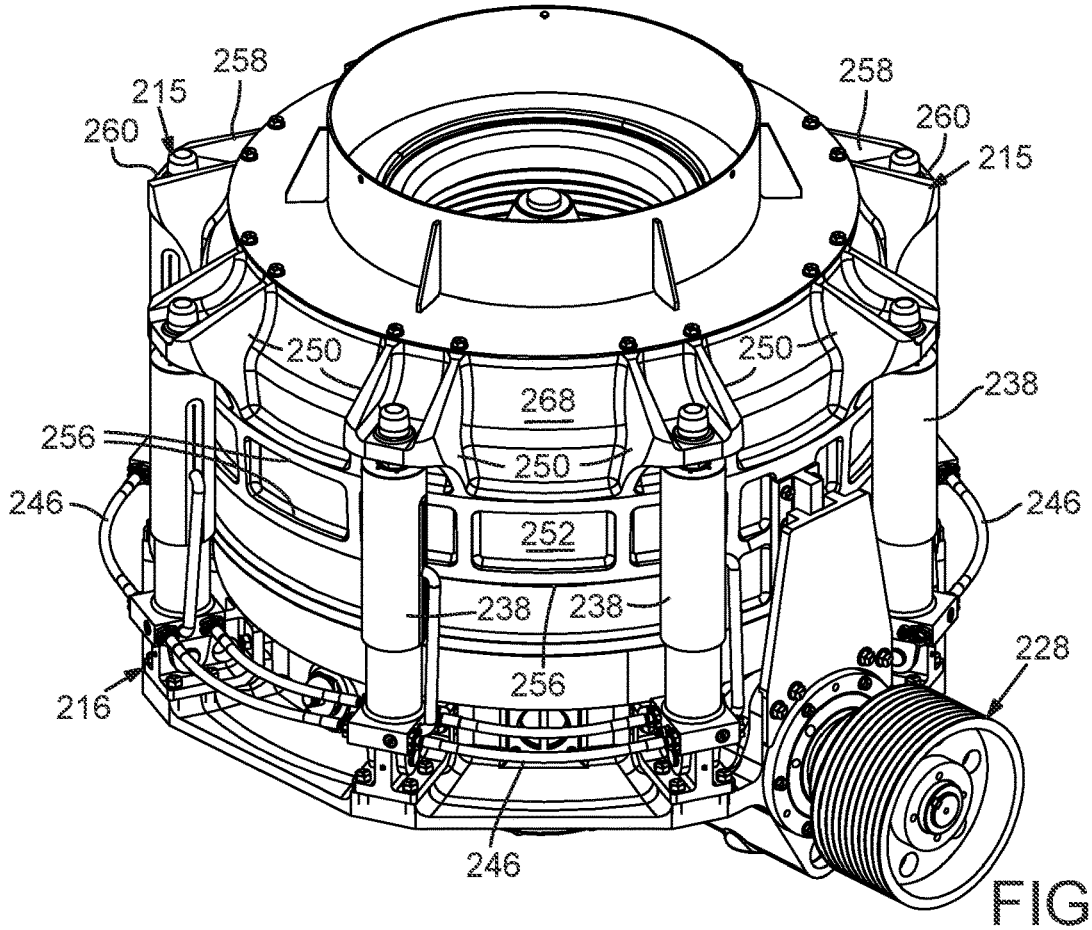
FIG. 7 is a perspective view of a third embodiment of the upper bowl support incorporated into a cone crusher.
Figure 7A:
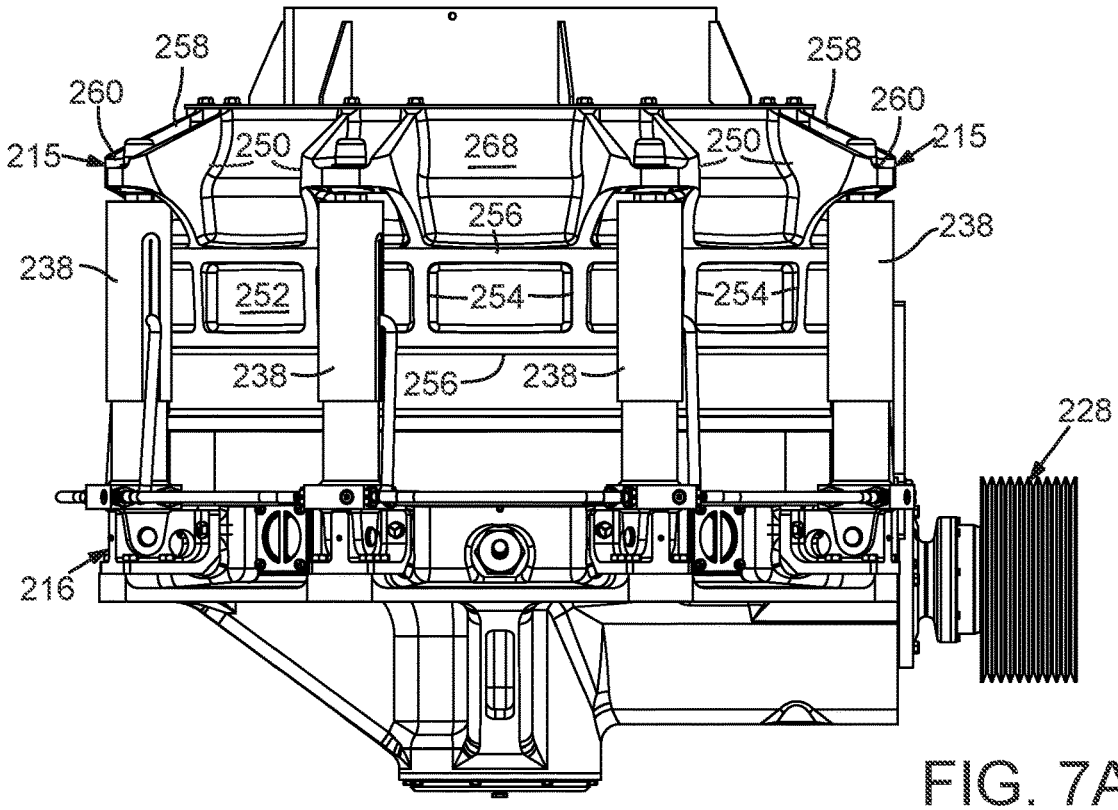
FIG. 7A is a side elevation view of the third embodiment of the upper bowl support incorporated into a cone crusher.

FIGS. 7 and 7A show generally downwardly-extending ribs 250 which extend along ear ribs 258. As in the first and second embodiments, each of the ears 215 is defined and supported by the pair of ear ribs 258 and an interconnecting ear platform 260. Generally downwardly-extending ribs 250 and circumferentially-extending ribs 256 form a polygon 268. In the depicted embodiment, this polygon 268 forms a generally parallelogram configuration, typically a regular or isosceles parallelogram. The term "generally parallelogram configuration" is used herein because as depicted, rib 250 is not precisely straight.

A rectangular configuration 252 may be formed generally below generally parallelogram configuration 268 between circumferentially-extending ribs 256 and downwardly-extending ribs 254. Rectangular configuration 252 may actually be square but that depends on the particular application.

As depicted, circumferential ribs 256 extend around the entire upper bowl support 214 but they can typically be lighter in weight than in conventional designs since the other ribs do such a good job of evenly distributing forces generated during crushing operations. In fact, it may be possible to dispense with the continuous circumferential rib in certain applications.

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope. Those with skill in the art will readily appreciate that embodiments may be implemented in a very wide variety of ways. This application is intended to cover any adaptations or variations of the embodiments discussed herein. Therefore, it is manifestly intended that embodiments be limited only by the claims and the equivalents thereof.

What is claimed is:

1. A cylindrical bowl support for a cone crusher, comprising:

a plurality of evenly, circumferentially spaced clamping cylinder ears around the periphery of the support; and the support having inwardly- and outwardly-facing surfaces, with a plurality of thickened ribs defined in the outwardly-facing surface of the support, some of the thickened ribs extending angularly downwardly and circumferentially from the ears to a first circumferentially-extending portion having two ends to define a hexagon, others of the thickened ribs extending angularly downwardly and circumferentially from the ends of the first circumferentially-extending portion to ends of adjacent hexagons formed in the periphery of the support, and other thickened ribs extending angularly downwardly and circumferentially from the ends of adjacent hexagons to a second circumferentially-extending portion to form abutting hexagon configurations to spread and absorb forces from a crushing operation.

2. The support of claim 1 wherein at least some of the hexagon are regular hexagon configurations.

3. The support of claim 1 wherein at least some of the hexagon are irregular hexagon configurations.

4. The support of claim 3 wherein at least some of the irregular hexagon configurations are of the same configuration as other irregular hexagon configurations but are inverted.

5. The cone crusher of claim 1 wherein at least some of the hexagon form a honeycomb configuration.

6. The cone crusher of claim 1 wherein the bowl support is defined by a wall of a given thickness, and the ribs having a thickness that is greater than that of the wall thickness.

7. A cone crusher, comprising:

a cylindrical bowl support;

the support having inwardly- and outwardly-facing surfaces, with a plurality of evenly, circumferentially spaced ears around the outwardly-facing surface of the support, the ears designed to have clamping cylinders mounted thereto to provide protection from tramp iron passing through the cone crusher; and the support having inwardly- and outwardly-facing surfaces, with a plurality of thickened ribs defined in the outwardly-facing surface of the support, at least some of the thickened ribs extending downwardly and circumferentially from the ears to a first circumferentially-extending portion having two ends to define a first polygon having six sides, others of the thickened ribs extending downwardly and circumferentially from the ears to form an adjacent, second, polygon having six sides and sharing at least one side with the first polygon to form a plurality of adjacent six-sided polygons to spread and absorb forces from a crushing operation.

8. The cone crusher of claim 7 wherein other ribs define at least one circumferentially-extending continuous ring forming portions of the first and second polygons.

* * * * *